US009512831B2

(12) United States Patent
Rill

(10) Patent No.: US 9,512,831 B2
(45) Date of Patent: Dec. 6, 2016

(54) HYDRAULICALLY DRIVEN COOLING FAN RESPONSIVE TO ENGINE LOAD

(75) Inventor: Egon Rill, Horb (DE)

(73) Assignee: Robert Bosch GmbH, Stuttgart, DE (US)

( * ) Notice: Subject to any disclaimer, the term of this patent is extended or adjusted under 35 U.S.C. 154(b) by 355 days.

(21) Appl. No.: 13/616,131

(22) Filed: Sep. 14, 2012

(65) Prior Publication Data

US 2013/0243611 A1 Sep. 19, 2013

(30) Foreign Application Priority Data

Sep. 15, 2011 (DE) ..... 10 2011 113 542

(51) Int. Cl.

| | |
|---|---|
| ***F04B 27/18*** | (2006.01) |
| ***F04B 49/06*** | (2006.01) |
| ***F04B 49/12*** | (2006.01) |
| ***F04B 49/02*** | (2006.01) |
| ***F04B 1/26*** | (2006.01) |
| ***F04B 1/34*** | (2006.01) |
| ***F04D 13/02*** | (2006.01) |

(Continued)

(52) U.S. Cl.

CPC ..... *F04B 27/18* (2013.01); *F01P 7/044* (2013.01); *F04B 1/26* (2013.01); *F04B 1/34* (2013.01); *F04B 17/05* (2013.01); *F04B 49/02* (2013.01); *F04B 49/06* (2013.01); *F04B 49/12* (2013.01); *F04D 13/02* (2013.01); *F01P 2025/62* (2013.01); *F01P 2025/64* (2013.01); *F04B 2201/12* (2013.01); *F04B 2205/06* (2013.01); *F04B 2207/044* (2013.01)

(58) Field of Classification Search

CPC ..... F04B 1/26; F04B 1/34; F04B 9/08; F04B 9/10; F04B 27/14; F04B 27/18;F04B 2201/12; F04B 2207/044; F04B 2205/06; F04D 13/02; F01P 7/004; F01P 2025/62; F01P 2025/64

USPC ..... 417/22, 28, 42, 46, 26

See application file for complete search history.

(56) References Cited

U.S. PATENT DOCUMENTS

| | | | | |
|---|---|---|---|---|
| 6,076,488 A * | 6/2000 | Yamagishi | ..... | 123/41.12 |
| 7,134,406 B1 * | 11/2006 | Loes | ..... | 123/41.11 |
| 7,415,945 B2 * | 8/2008 | Tuttle | ..... | 123/41.11 |

(Continued)

FOREIGN PATENT DOCUMENTS

| | | | | |
|---|---|---|---|---|
| DE | 43 21 636 * | 1/1995 | ..... | F01P 7/00 |
| DE | 43 21 636 A1 | 1/1995 | | |
| DE | 43 21 637 A1 | 1/1995 | | |

OTHER PUBLICATIONS

Machine Translation, DE 43 21 636, Patent Translate, espacenet.com, 14 pages, downloaded Jul. 23, 2015.*

*Primary Examiner* — Bryan Lettman
*Assistant Examiner* — Timothy P Solak
(74) *Attorney, Agent, or Firm* — Maginot, Moore & Beck LLP

(57) ABSTRACT

A hydraulic fan drive for a cooling system of an internal combustion engine, in particular a diesel engine of a mobile working machine or a construction machine, is configured to be switched off for a short time or by way of a transition in dependence on a load of the internal combustion engine. A shut-off valve, which is arranged in a working line connecting a variable-displacement pump to a fan motor, is configured to switch off the fan drive. The fan drive is further configured to be switched off by rotational speed monitoring of the internal combustion engine.

4 Claims, 1 Drawing Sheet

(51) Int. Cl.
*F04B 17/05* (2006.01)
*F01P 7/04* (2006.01)

(56) References Cited

U.S. PATENT DOCUMENTS

| | | | | |
|---|---|---|---|---|
| 7,841,307 | B2 * | 11/2010 | Itoga et al. | 123/41.12 |
| 2009/0120386 | A1 * | 5/2009 | Kamado et al. | 123/41.11 |
| 2010/0107996 | A1 * | 5/2010 | Shintani et al. | 123/41.11 |
| 2010/0132352 | A1 * | 6/2010 | Throckmorton | 60/422 |
| 2010/0303643 | A1 * | 12/2010 | Kataoka et al. | 417/213 |

* cited by examiner

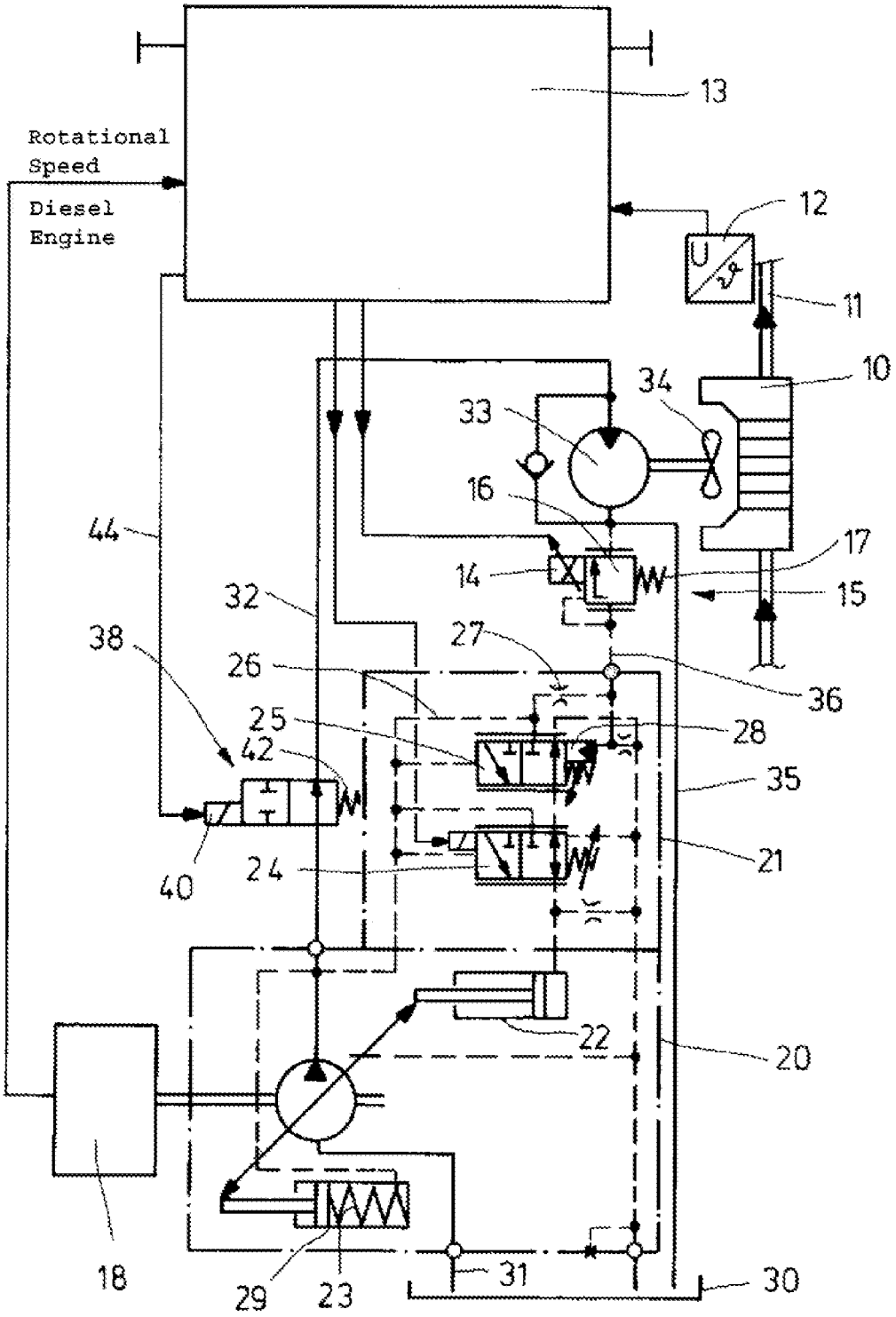
Rotational
Speed
Diesel
Engine
13
12
11
10
34
33
16
17
14
15
44
32
38
27
26
36
25
28
42
35
40
24
21
22
20
18
29
23
31
30

HYDRAULICALLY DRIVEN COOLING FAN RESPONSIVE TO ENGINE LOAD

This application claims priority under 35 U.S.C. §119 to patent application Ser. No. DE 10 2011 113 542.5, filed on Sep. 15, 2011 in Germany, the disclosure of which is incorporated herein by reference in its entirety.

BACKGROUND

The disclosure relates to a hydraulic fan drive for a cooling system of an internal combustion engine.

DE 43 21 637 A1 discloses a hydraulic fan drive for a cooling system of an internal combustion engine. The fan drive has a variable-displacement pump driven by the internal combustion engine, and a constant-displacement motor which drives a fan wheel. In this case, the variable-displacement pump is regulated by an actuating cylinder and by a valve which corresponds to a load-sensing regulating valve. A control pressure can be generated with the aid of a nozzle and a proportionally adjustable pressure-limiting valve from the pumping pressure prevailing in the connecting line between the variable-displacement pump and the constant-displacement motor.

DE 43 21 636 A1 shows a comparable hydraulic fan drive, comprising a variable-displacement pump driven by an internal combustion engine and comprising a constant-displacement motor which drives a fan wheel. During a switching-on time of a starter motor of the internal combustion engine, the variable-displacement pump is briefly set to a small delivery quantity or to a zero delivery quantity in order to reduce the load and the driving torque of the starter motor.

A disadvantage of hydraulic fan drives of this type is that load peaks of the internal combustion engine that may arise during the operation thereof, for example because of a plurality of supplied consumers, are increased even further by the connected fan drive.

By contrast, the disclosure is based on the object of providing a hydraulic fan drive for an internal combustion engine, said fan drive reducing load peaks of the internal combustion engine.

SUMMARY

This object is achieved by a hydraulic fan drive having the features of the disclosure.

The hydraulic fan drive according to the disclosure is provided for a cooling system of an internal combustion engine—in particular of a diesel engine of a mobile working machine or a construction machine—and can be switched off in dependence on a load of the internal combustion engine. A hydraulic fan drive which reduces load peaks of the internal combustion engine is therefore created. Exhaust gases and soot emission can therefore be reduced and the service life of the internal combustion engine extended.

Further advantageous refinements of the disclosure are described in the dependent patent claims.

In a particularly preferred development, the fan drive can be switched off in dependence on a rotational speed of the internal combustion engine. The switching off can be undertaken if the rotational speed drops below a threshold value or a rotational speed drop exceeds a threshold value. An increasing load of the internal combustion engine can therefore be determined in a simple manner—for example with a rotational speed sensor.

An advantageous embodiment has a variable-displacement pump drivable by the internal combustion engine and a constant-displacement motor drivable by the variable-displacement pump. A fan wheel is drivable via the constant-displacement motor, or a fan wheel is coupled to the constant-displacement motor.

In device terms, the switching off according to the disclosure is undertaken in a simple manner via a shut-off valve which is arranged in a main line between the variable-displacement pump and the constant-displacement motor.

An energy-saving development of the fan drive according to the disclosure has a load-sensing valve via which an actuating cylinder of the variable-displacement pump is controlled in dependence on a pumping pressure tapped off by the main line, a load-sensing pressure and on a spring force, said actuating cylinder acting in the direction of reducing the pivoting angle of the variable-displacement pump when pressure medium is supplied.

A control pressure line is preferably provided, in which a further control pressure prevails, the control pressure reacting to the pumping pressure on a valve body of the load-sensing valve, and a pressure-regulating valve is provided. The control pressure can therefore be regulated via the pressure-regulating valve. Regulation for the pivoting angle of the variable-displacement pump is therefore provided, wherein the further control pressure acts indirectly in the direction of reducing the pivoting angle and therefore of reducing the delivery flow of the variable-displacement pump.

As an alternative or in addition, in order to limit the maximum pressure, it is possible to provide a pressure-regulating valve via which the actuating cylinder of the variable-displacement pump is actuated in the direction of reducing the pivoting angle of the variable-displacement pump in dependence on the pumping pressure tapped off from the main line.

A particularly preferred development of the fan drive has an electronic regulating unit via which the fan drive can be switched off.

In this case, it is preferred if the shut-off valve can be switched off by the electronic regulating unit. This can be undertaken in particular via an actuator, upon the activation of which the main line is shut off.

In the development with the pressure-regulating valve, it is preferred if the latter can be regulated by the electronic regulating unit. This can be undertaken in particular via an actuator, upon the activation of which—in particular energizing—an opening of the pressure-regulating valve is increased, thus reducing the further control pressure.

Furthermore, it is preferred if a control pressure line which has the pumping pressure acting in the direction of a reduction of the pivoting angle is connected via a constrictor to a further control pressure line which has further control pressure reacting to the pumping pressure.

BRIEF DESCRIPTION OF THE DRAWINGS

An exemplary embodiment of the disclosure is described in detail below with reference to a single FIGURE.

The sole figure shows a hydraulic and electric circuit diagram of the exemplary embodiment of a hydraulic fan drive according to the disclosure.

DETAILED DESCRIPTION

The FIGURE shows a diesel engine 18 with a radiator 10 through which a coolant 11 flows. The coolant flows there-through and cools a diesel engine 18. A temperature sensor 12 detects the temperature of the coolant 11 and transmits a corresponding voltage signal to an electronic regulating unit 13. Furthermore, a rotational speed of the diesel engine 18 is transmitted to the electronic regulating unit 13 via an electronic signal.

The radiator 10 is operatively connected to a fan wheel 34 which is driven via an open hydraulic circuit. The latter consists of a variable-displacement pump 20 which drives a constant-displacement motor 33 via a main line 32. The variable-displacement pump 20 is driven by the diesel engine 18 while the constant-displacement motor 33 drives the fan wheel 34. Expanded pressure medium flows from the constant-displacement motor 33 back via a tank line 35 to a tank 30, from which the variable-displacement pump 20 sucks up the pressure medium via a suction line 31.

The variable-displacement pump 20 is an axial piston pump, the pivoting angle of which can be reduced with the aid of a single-action actuating cylinder 22 and with a compression spring 23 acting counter to the actuating cylinder 22, and can be increased with a further actuating cylinder 29 having a smaller operative surface. The actuating cylinder 22 which acts in the direction of reducing the pivoting angle is controlled via a pressure-regulating unit 21. The pressure-regulating unit 21 has a load-sensing valve 25 and a pressure-regulating valve 24 which is connected in series therewith and is provided for limiting the maximum pressure of the main line 32. The two valves 24, 25 are connected to the main line 32 via a control line 26. The two valves 24, 25 are therefore acted upon by the pumping pressure tapped off from the main line 32 and, as the pumping pressure increases, act in the direction of reducing the pivoting angle of the variable-displacement pump 20. For this purpose, the pumping pressure acts on respective valve bodies (not shown specifically) of the valves 24, 25 in such a manner that, in the event of an excess weight of the force generated on the valve body by the pumping pressure, pressure medium flows to the actuating cylinder 22 and the pivoting angle of the pump is reduced.

The control line 26 is connected to a further control pressure line 36 via a constrictor 27. Via said control pressure line 36 and via a control chamber 28, the valve body of the load-sensing valve 25 is acted upon with a control pressure (called pumping pressure in other applications) counter to the pumping pressure. The valve body of the load-sensing valve 25 is also acted upon counter to the pumping pressure by a spring, the pressure equivalent of which lies, for example, within the range of 5 to 10 bar. The control pressure in the further control pressure line 36 and the spring act on the load-sensing valve with the effect of increasing the pivoting angle of the variable-displacement pump 20. In this case, the control pressure acting in the further control pressure line 36 is adjusted via a pressure-limiting valve 15. For this purpose, a proportional magnet 14 of the pressure-limiting valve 15 is activated by the electronic regulating unit 13. The pressure-limiting valve 15 has a closing body 16 which is acted upon in the closing direction by a comparatively strongly prestressed compression spring 17 and in the opening direction by the proportional magnet 14 and by the pressure at the input of the pressure-limiting valve 15. Said pressure is tapped off by the control pressure line 36. In a static state, a pumping pressure is therefore set, said pump pressure being higher by the pressure equivalent of the spring acting upon the load-sensing valve than the control pressure or pumping pressure set by the pressure-limiting valve 15. The pressure-limiting valve 15 is a pressure-limiting valve having a falling characteristic.

At a given temperature of the coolant 11, which temperature is detected by the temperature sensor 12, and at a given rotational speed of the diesel engine 18 driving the variable-displacement pump 20, the actuating cylinder 22 adopts such a position, and therefore the variable-displacement pump 20 adopts such a pivoting angle that so much pressure medium is delivered to the constant-displacement motor 33 by the main line 32 that, at the resultant rotational speed of the fan wheel 34, the temperature of the coolant 11 remains approximately constant. In this case, the pivoting angle is set indirectly by the pumping pressure because, in the case of a hydraulic fan drive, there is a fixed relationship between the pressure differential prevailing via the driving constant hydraulic motor (corresponds to a torque) and the rotational speed of the fan wheel.

If the rotational speed of the diesel engine 18 is increased, the delivery quantity of the variable-displacement pump 20 is increased and therefore so is the pressure in the main line 32. The control pressure of the further control pressure line 36 remains constant because of an unchanged setting of the pressure-limiting valve 15. This means that a force imbalance occurs at the valve body of the load-sensing valve 25, and the load-sensing valve 25 connects the actuating cylinder 22 to the main valve 32 such that the variable-displacement pump 20 is pivoted back in the direction of a smaller delivery quantity. Given a reduction in the rotational speed of the diesel engine 18, the regulating operation proceeds in the direction of a larger pivoting angle of the variable-displacement pump 20. The regulation therefore leads to the pressure in the main line 32 being kept constant at a certain temperature of the coolant 11 irrespective of the rotational speed of the variable-displacement pump 20.

If, by contrast, the temperature of the coolant 11 is increased (or reduced), the electronic regulating unit 13 changes the control signal for the proportional magnet 14. The dynamic effect thereof on the valve body 16 of the pressure-limiting valve 15 becomes smaller (or greater), and therefore the control pressure in the further control pressure line 36 becomes greater (or smaller). A force imbalance is therefore produced at the valve 25, said force imbalance causing pressure medium to flow out of the actuating cylinder 22 (or is supplied to the actuating cylinder) until a change in the pivoting angle of the pump sets such a pumping pressure that a force balance again prevails at the valve 25 when the cooling power is changed.

The main line 32 contains a shut-off valve 38 via which the main line 32 can be shut off. For this purpose, use is made of an electric actuator 40 via which a valve body (not shown specifically) of the shut-off valve 38 can be brought into a closed position counter to the force of a spring 42. This is undertaken via a control signal which can be transmitted from the electronic regulating unit 13 to the shut-off valve 38 via a control line 44.

If, during the operation of the diesel engine 18, a load peak acts on the latter, said load peak is detected by the electronic regulating unit 13 via a rotational speed sensor (not shown). The shut-off valve 38 is then brought via the electronic control unit 13 into the closed position thereof, as a result of which the pumping pressure abruptly rises in the control line 26. As a result, the load-sensing valve 25 and/or the pressure limiting pressure-regulating valve 24 act(s) upon the actuating piston 22 with an additional amount of pressure medium, thus causing the variable-displacement pump 20 to pivot back. This results in a brief switching off according to the disclosure of the shown hydraulic fan drive and to load relief of the diesel engine.

If the electronic regulating unit 13 identifies a load relief of the diesel engine 18 or a rise in the rotational speed, the fan drive is switched on again.

A hydraulic fan drive which is provided for a cooling system of an internal combustion engine—in particular a diesel engine of a mobile working machine or a construction machine—is disclosed. The fan drive can be switched off temporarily or in a transitional manner in dependence on a load of the internal combustion engine. The switching off can be undertaken by means of a shut-off valve which is arranged in a working line connecting a variable-displacement pump to a fan motor. The switching off can be undertaken via a monitoring of the rotational speed of the internal combustion engine.

What is claimed is:

1. A hydraulic fan drive for a cooling system of an internal combustion engine, comprising:

a variable displacement pump driven by the internal combustion engine;

a constant displacement motor driven by the variable displacement pump and operably connected to a fan wheel to rotationally drive the fan wheel;

a main line hydraulically connecting the variable displacement pump to the constant displacement motor;

an electronic regulating unit operably connected to the constant displacement motor, the electronic regulating unit configured to regulate a temperature of a fluid in a radiator using the constant displacement motor;

an actuating cylinder configured to decrease and increase, respectively, a pivot angle of the variable displacement pump;

a load-sensing valve acted upon in a first direction by a pumping pressure force in a control line hydraulically connecting the load-sensing valve to the main line and acted upon in a second direction by a load sensing pressure force in a further control line, which is hydraulically connected to the control line by a constrictor, and a first spring force of a first spring, the load-sensing valve configured to supply pressure medium to the actuating cylinder when the pumping pressure force exceeds a sum of the load sensing pressure force and the first spring force and to drain pressure medium from the actuating cylinder when the sum of the load sensing pressure force and the first spring force exceeds the pumping pressure force;

a pressure-limiting valve hydraulically connected to the further control line and configured to set the load sensing pressure based upon a second spring force of a second spring and a magnet force of a proportional magnet operably connected to the electronic regulating unit, the electronic regulating unit configured to control the proportional magnet based upon the temperature of the fluid;

a pressure-regulating valve hydraulically positioned between the load-sensing valve and the actuation cylinder and configured to supply the pressure medium to the actuating cylinder to reduce the pivoting angle of the variable-displacement pump when the pumping pressure reaches a maximum pumping pressure; and a shut off valve arranged in the main line and configured to open and close to enable and prevent, respectively, flow through the main line, wherein the electronic regulating unit is configured to prevent the flow through the main line by controlling the shut off valve to close in response to a sensed increase in a load of the internal combustion engine.

2. The hydraulic fan drive of claim 1, wherein the electronic regulating unit is configured to sense the increase in the load of the internal combustion engine based upon a speed of the internal combustion engine.

3. The hydraulic fan drive of claim 1, wherein the electronic regulating unit configured to control the proportional magnet based upon the temperature of the fluid so as to maintain the temperature of the fluid approximately constant.

4. The hydraulic fan drive of claim 1, wherein the hydraulic fan drive is configured such that the pumping pressure reaches the maximum pumping pressure in response to the shut off valve being controlled to close.

* * * * *